United States Patent [19]

Monin

[11] 4,221,072

[45] Sep. 9, 1980

[54] TOY PRODUCING A DRIVER'S SECTION OF A VEHICLE

[76] Inventor: André Monin, rue Port d'Ouvey, Romans (Drôme), France

[21] Appl. No.: 970,127

[22] Filed: Dec. 12, 1978

[30] Foreign Application Priority Data

Dec. 19, 1977 [FR] France ..... 77 39371

[51] Int. Cl.[3] ..... A63H 33/00

[52] U.S. Cl. ..... 46/1 B; 35/11 R

[58] Field of Search ..... 46/1 B; 35/11 R; 272/1 C

[56] References Cited

U.S. PATENT DOCUMENTS 2,322,403 6/1943 Kieft ..... 46/1 B UX 2,814,156 11/1957 Cislak ..... 46/1 B

FOREIGN PATENT DOCUMENTS 934149 5/1948 France ..... 46/1 B

*Primary Examiner*—Louis G. Mancene

*Assistant Examiner*—Mickey Yu

*Attorney, Agent, or Firm*—Browdy and Neimark

[57] ABSTRACT

A toy reproducing the driver's section of a motor vehicle retained in position with the child's thighs and equipped with at least an extension on which a steering wheel is mounted, in order to simulate driving of the motor vehicle by the child.

5 Claims, 2 Drawing Figures

TOY PRODUCING A DRIVER'S SECTION OF A VEHICLE

FIELD OF THE INVENTION

This invention relates to a toy reproducing a driver's section of a vehicle, and more particularly, of an autovehicle.

BACKGROUND OF THE INVENTION

Riding in autovehicles for medium or long periods is very often fatiguing for children ages 5 to 10. Actually, at this age the child is not capable of carrying on a conversation for long and is not interested in the scenery so that after a relatively short time he becomes bored and very often shows this boredom in a way which can disturb the driver and cause him nervous irritation.

SUMMARY OF THE INVENTION

It is an object of the present invention to provide a toy which can be used, more particularly but not exclusively, in an autovehicle by children of about 5–10 years of age to provide pleasure for the child and to obviate the problem noted above. This toy, reproducing a vehicle driver section, comprises a support which, retained in place by child's thighs to fix the device in postion, e.g. in an automobile, is provided with at least an extension on which a steering wheel is mounted.

This toy allows the child to make the same motions as the driver, which, on the one hand, occupies him and, on the other hand, gives him notions of driving that will be useful later. The advantage of this device is that it is entirely independent and does not require any special device for attachment to the vehicle.

Advantageously, the support comprises a part intended to be held between at least a thigh of the child and a surface such as a seat. Fastening of the toy is achieved by simple resting of the weight of the child's body.

Further, the support has a part approximately crosswise to the child's thighs, the upper face of which has a hollowed or curved shape to fit the shape of the thighs. The support is equipped in the area located between the child's legs with an extension projecting in a forward direction for mounting the steering wheel and, optionally, other accessories.

According to an embodiment of the invention, the support comprises two zones to support the child's thighs. According to another embodiment, the support is equipped so the child rests only one thigh on it, the other thigh of the child resting on its inside face against a hollow shaped face of the support. This support can also be extended backward to form the beginning of a seat.

The support extension, on which the steering wheel is mounted, forms a dashboard comprising dials and lights. In operating the equipment, it is possible to provide a contact key and a battery-powered circuit for controlling the lighting of the lights corresponding, for example, to two directional signals or the like.

Further, the steering wheel is mounted to pivot at the end of a tubular element sliding in an adjustable manner in a second tubular element, itself articulated around a horizontal shaft which is crosswise to the steering wheel and capable of being locked in the desired position. This arrangement makes it possible to adjust the steering wheel in height and inclination to assure fitting of the toy to the child's size.

According to another characteristic of the invention, the support is equipped with a lateral extension for mounting of a gear shift. Further, the support is provided with extension projecting forward and downward for mounting of pedals. In this case, a pedal, corresponding to the clutch pedal, is connected by a cable to a pin which, associated with elastic means, normally assures locking of the gear shift. Another pedal, corresponding to the accelerator pedal, is connected by a cable to a needle of a dial simulating the speedometer. Prior to any maneuvering of the gear shift, the child will have to exert a pressure on the clutch pedal to cause an unlocking of the lever.

Advantageously, the various extensions of the support are mounted detachably and/or in an articulated manner on the support. On the one hand, this makes it possible to have a base module consisting of a support, dashboard, and steering wheel to which can be later added accessories such as the support console of the gear shift, and an assembly comprising the pedals; and, on the other hand, makes it possible to store the unit in a small space when not in use.

BRIEF DESCRIPTION OF THE DRAWINGS

In any case, the invention will be better understood from the following description with reference to the accompanying drawing showing, by way of nonlimiting examples, two embodiments of this toy.

DETAILED DESCRIPTION OF THE PREFERRED EMBODIMENT

Figure 1:
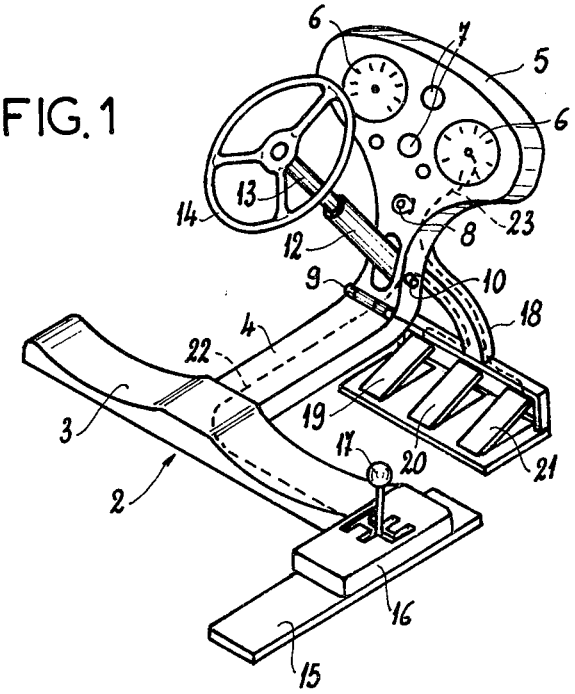
FIG. 1 is a perspective view of a first embodiment of this toy.

The toy, shown in FIG. 1, comprises a support 2 made of semiflexible and noncutting synthetic material comprising, on its upper face, two hollow shapes 3 each intended to support one of the child's thighs during use. The bottom of the support 2 is adapted to rest on a relatively flat surface, such as the seat of an automobile.

This support 2 is provided toward its front with an extension 4, an end of which is directed upward to form a dashboard 5 comprising, particularly, dials 6, control light 7, a contact key 8, etc.

The part forming the dashboard 5 is articulated on extension 4 around a horizontal shaft 9 so that the unit can be stored in as small a space as possible. In the lower part of the dashboard 5 is mounted, in an articulated manner around a shaft 10, a tubular element 12. Such tubular element 12 is provided with suitable means for locking the shaft 10 in the desired position. A tubular element 13 adjustably slides in the tube 12. A rotatable steering wheel 14 is mounted at the end of the tubular element 13. The combination of the pivoting of tube 12 around the horizontal shaft 10 and the telescoping of the element 13 in the tube 12 makes it possible to adjust the inclination and height of the steering wheel.

Laterally and on its right side, support 2 is provided with a detachable extension 15 carrying a console 16 on which a gear shift lever 17 is mounted.

The support 2 is equipped with an extension 18 projecting forward and downward from the extension 4 and on which are mounted three pedals 19, 20 and 21, corresponding, respectively, to the clutch, brake and accelerator pedals. Pedal 19 is connected by a cable 22 to a locking pin or bolt, not shown in the drawing, acting on the gear shift 17. To be able to operate the gear shift lever 17, the locking pin or bolt is moved away by exerting a pull on cable 22 by depressing the clutch 19.

For its part, the accelerator pedal 21 acts on a cable 23 connected to a needle of a dial which is intended to simulate, for example, the speedometer. Brake pedal 20 can, for its part, be provided with a contact switch and suitable wiring so as to act, when operated, on the contact causing the lighting up of one of the lights placed on the dashboard.

Figure 2:
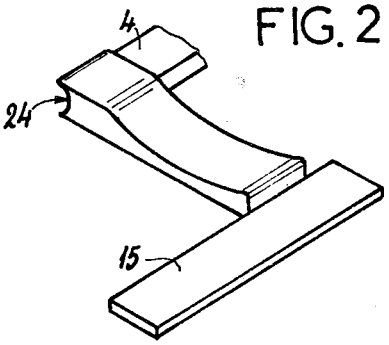
FIG. 2 is a perspective view of a second type of support.

FIG. 2 corresponds to a variant embodiment of this toy whereby its positioning in, e.g. the back seat of an automobile, is achieved by a support comprising only one support surface for one thigh. This support comprises a lateral face opposite that equipped with extension 15 exhibiting a hollow shape 24 making it possible to support the inside face of the child's thigh not resting on the support from above.

It is intended that the invention is not to be limited merely to the embodiments described above by way of example; on the contrary, it encompasses all variant embodiments. Thus, for example, the support could be made of two pieces covering the child's thighs without, thereby, going outside the scope of the invention.

What is claimed is:

1. A toy simulating a driver section of a motor vehicle, comprising a support adapted to rest on the seat of a motor vehicle and be retained in position thereon by a child's thighs exerting pressure thereon to achieve fixing of the toy in its use position; and an upper extension projecting forwardly from said support and on which a steering wheel is mounted, said support being provided with lower extension projecting forwardly and downwardly mounting at least one foot pedal; a lateral extension for said support, said lateral extension mounting a gear shift lever, wherein said pedal simulates a clutch pedal and is connected by a cable to pin which, connected to an elastic means, normally assures locking of gear shift lever, and a second pedal on said lower extension simulating an accelator pedal and being connected by a cable to the needle of a dial simulating a speedometer.

2. A toy according to claim 1, wherein said support comprises a part adapted to be held between at least one thigh of the child and a surface such as a seat.

3. A toy according to claim 2, wherein said support has a part approximately crosswise to the child's thighs, the upper face of which has a curved shape to fit the form of the thighs, said upper extension being located at a position adapted to lie between the child's legs and projecting forwardly and upwardly for mounting of said steering wheel.

4. A toy according to claim 3, wherein said steering wheel is mounted to pivot at the end of a tubular element silding adjustably in a second tubular element, itself articulated around a horizontal shaft that extends crosswise said steering wheel, and means to lock said steering wheel in the desired position.

5. A toy in according with claim 1 further comprising a third pedal on said lower extension for simulating a brake pedal.

* * * * *